US007340071B2

(12) United States Patent
Huang

(10) Patent No.: US 7,340,071 B2
(45) Date of Patent: Mar. 4, 2008

(54) HEADPHONES WITH A MULTICHANNEL GUIDING MECHANISM

(76) Inventor: Jui-Shu Huang, No. 2, Hung Chang 11th Street, Taoyuan City (TW)

( * ) Notice: Subject to any disclaimer, the term of this patent is extended or adjusted under 35 U.S.C. 154(b) by 835 days.

(21) Appl. No.: 10/857,872

(22) Filed: Jun. 2, 2004

(65) Prior Publication Data

US 2004/0218775 A1 Nov. 4, 2004

(51) Int. Cl.
*H04R 5/02* (2006.01)

(52) U.S. Cl. ..... 381/309; 381/371

(58) Field of Classification Search ..... 381/309, 381/74, 87, 334, 371, 382; 181/129
See application file for complete search history.

(56) References Cited

U.S. PATENT DOCUMENTS 6,356,644 B1 * 3/2002 Pollak ..... 381/371
2004/0109576 A1 * 6/2004 You et al. ..... 381/309

* cited by examiner

*Primary Examiner*—Ping Lee
(74) *Attorney, Agent, or Firm*—Rosenberg, Klein & Lee

(57) ABSTRACT

Headphones with a multichannel guiding mechanism having different channel speakers positioned within each of earphones and separate sound-guiding chambers for receiving the different channel speakers. In taking the acoustics into account, the separate sound chambers are installed within the earphones according to the sound effect of different channel speakers. An inner and an outer tube are installed within the first sound chamber. The inner tube defines a treble area in the middle of the front main speaker while the outer tube defines a bass area around the treble area whereby the first sound chamber has a tube-in-tube configuration. Accordingly, a clear positioning of the acoustic field is achieved by different installation position of the speakers within the earphones. In addition, the interference of sound waves is avoided and the reproduction of original sound is achieved.

7 Claims, 9 Drawing Sheets

HEADPHONES WITH A MULTICHANNEL GUIDING MECHANISM

BACKGROUND OF THE INVENTION

1. Field of the Invention

The invention relates to an improved structure of headphones with a multichannel guiding mechanism, and more particularly, to headphones having different channel speakers positioned within each of earphones and separate sound-guiding chambers for receiving the different channel speakers. In taking the acoustics into account, the separate sound chambers are installed within the earphones according to characteristics of the sound effect of different channel speakers. Accordingly, a clear positioning of the acoustic field is achieved by different installation position of the speakers within the earphones. In addition, the interference of sound waves is avoided and the reproduction of original sound is achieved.

2. Description of the Related Art

Multichannel or 5.1-channel output enables the listeners to enjoy a high quality of sound. However, the original sound can't be reproduced by the conventional headphones. Thus, when they wear the headphones, the sound quality of multichannel or 5.1-channel output must be deteriorated to some extent.

U.S. Pat. No. 3,984,885 teaches a "4-channel headphones" that a combination of a front, a middle, and a rear speakers is fitted in the earphones. However, these three speakers don't have their own sound chambers (or sound tubes), thereby resulting in mixture of different channel sounds. Thus, an expected surround sound quality can't be achieved.

U.S. Pat. No. 6,356,644 teaches an "earphone (surround sound) speaker" having two speakers with their own sound chambers. However, they are partitioned only by a chamber wall. In comparison to the three speakers of U.S. Pat. No. 3,984,885 that are not completely separated, the configuration disclosed by U.S. Pat. No. 6,356,644 has a better separating effect and, therefore, a better sound reproduction effect. Nevertheless, it still leaves something to be desired with respect to the multichannel or 5.1-channel reproduction of original sound since each channel speaker has its own characteristics and the only partition for them is just not sufficient. In order to reach the multichannel or 5.1-channel reproduction of original sound, the design of the sound chamber must be adapted to the characteristics of the respective channel speaker. For example, the front main channel speaker has to be larger than others. Moreover, its middle section belongs to the treble area while the periphery of the treble area belongs to the bass area. The inventor of the invention found that the treble and the bass are easily mixed and, thereby resulting in a worse sound quality when the treble and the bass are not properly separated.

SUMMARY OF THE INVENTION

It is a primary object of the invention to eliminate the aforementioned drawbacks and to provide headphones having a separate sound-guiding chamber for each speaker.

Meanwhile, the sound chambers are designed according to the characteristics of each channel speaker and in taking acoustic principles and transmission structure into account. This allows a clear positioning of the acoustic field. In addition, the interference of sound waves is avoided and the reproduction of original sound is achieved. Furthermore, the sound pressure is uniformly dissipated within each separate sound chamber, thereby enlarging the surround sound effect. So, the listener can enjoy high quality multichannel sound effect without electronic combination technique for 5.1-channel simulation.

It is another object of the invention to provide headphones in which the sound chamber for the front main channel speaker has a tube-in-tube configuration for separating the central treble area from the peripheral bass area of the main channel speaker. So, a clearer treble and bass acoustic fields can be defined to improve the reproduction effect of the original sound.

It is a further object of the invention to provide headphones in which the subwoofer within the second sound chamber is disposed at a certain angle relative to a horizontal plane such that it is downwardly inclined to protect the human ears from direct exposure to the output sound waves and to create a surround spatial acoustic field for the user's ears.

It is still another object of the invention to provide headphones further comprising a rear surround speaker and its separate sound chamber. The exit of the separate sound chamber is located at the rear side of the earphone. Meanwhile, the sound tube for defining the sound chamber can be extended for delaying the output of the sound waves, thereby resulting in a rear positioning of the sound. When the sound is transmitted by an elongated tube, more dissipating surround sound fields are available to enhance the 5.1-channel sound effect.

BRIEF DESCRIPTION OF THE DRAWINGS

The accomplishment of this and other objects of the invention will become apparent from the following descriptions and its accompanying drawings of which.

DETAILED DESCRIPTION OF THE PREFERRED EMBODIMENT

Figure 1:
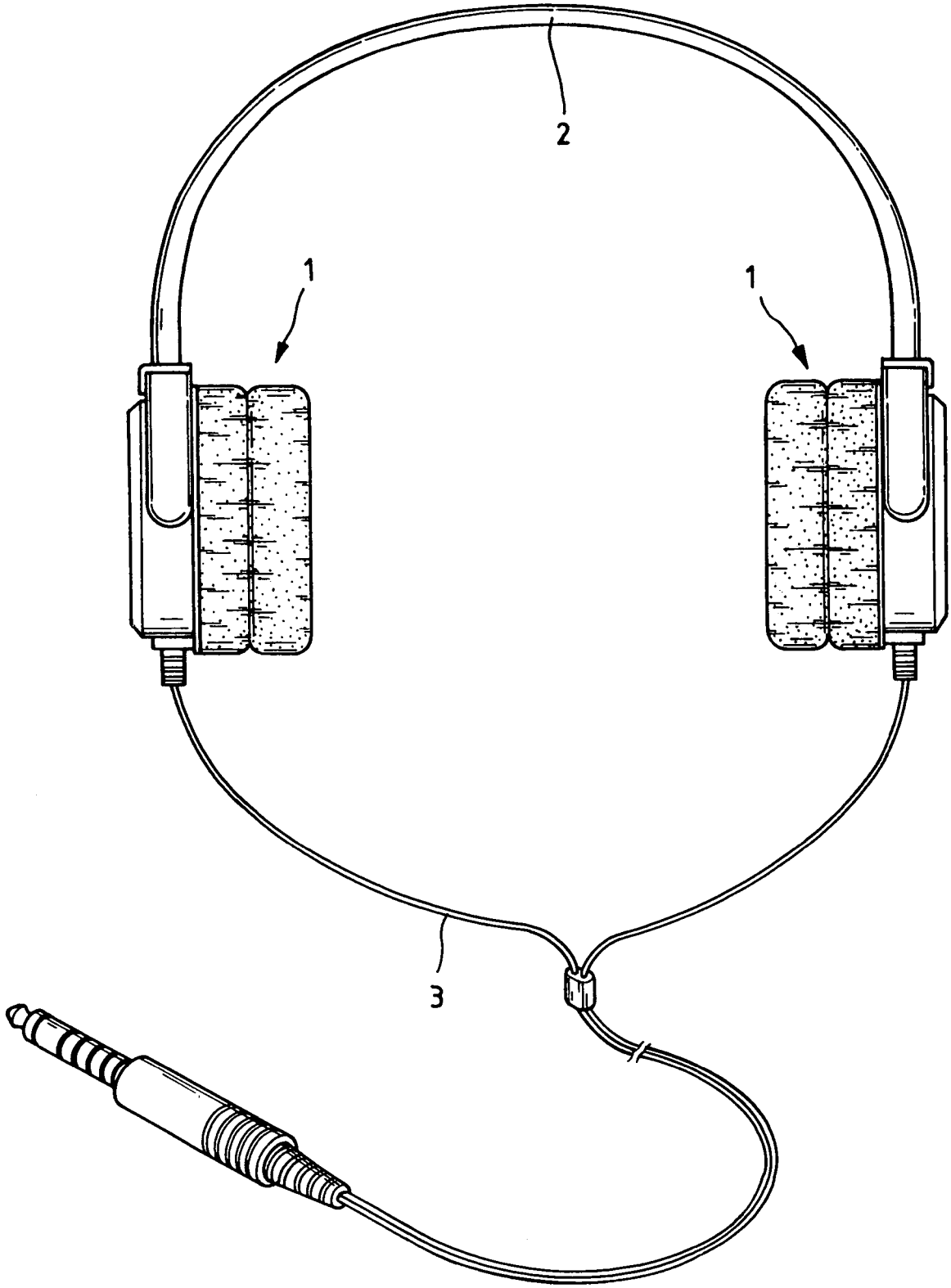
FIG. 1 is a schematic drawing of a preferred embodiment of the invention.

First of all, referring to FIG. 1, a headphone with multichannel guiding mechanism in accordance with a first embodiment of the invention includes a pair of earphones 1 with a headband 2 for holding them on the top of the head. Meanwhile, an electric cord for transmitting multichannel sound signals is connected under the earphones 1.

Figure 2:
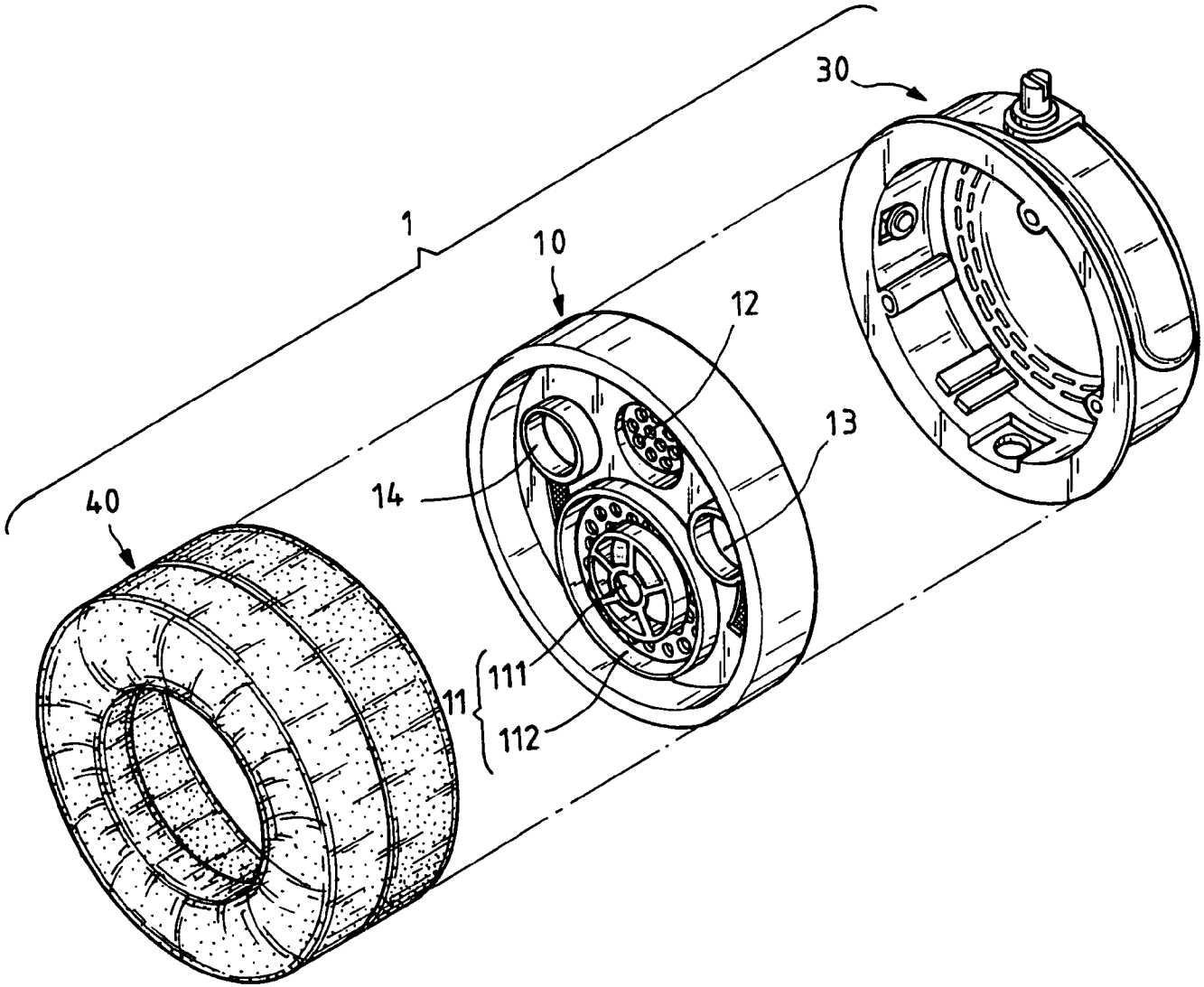
FIG. 2 is an exploded view of the earphone of the invention.
Figure 3:
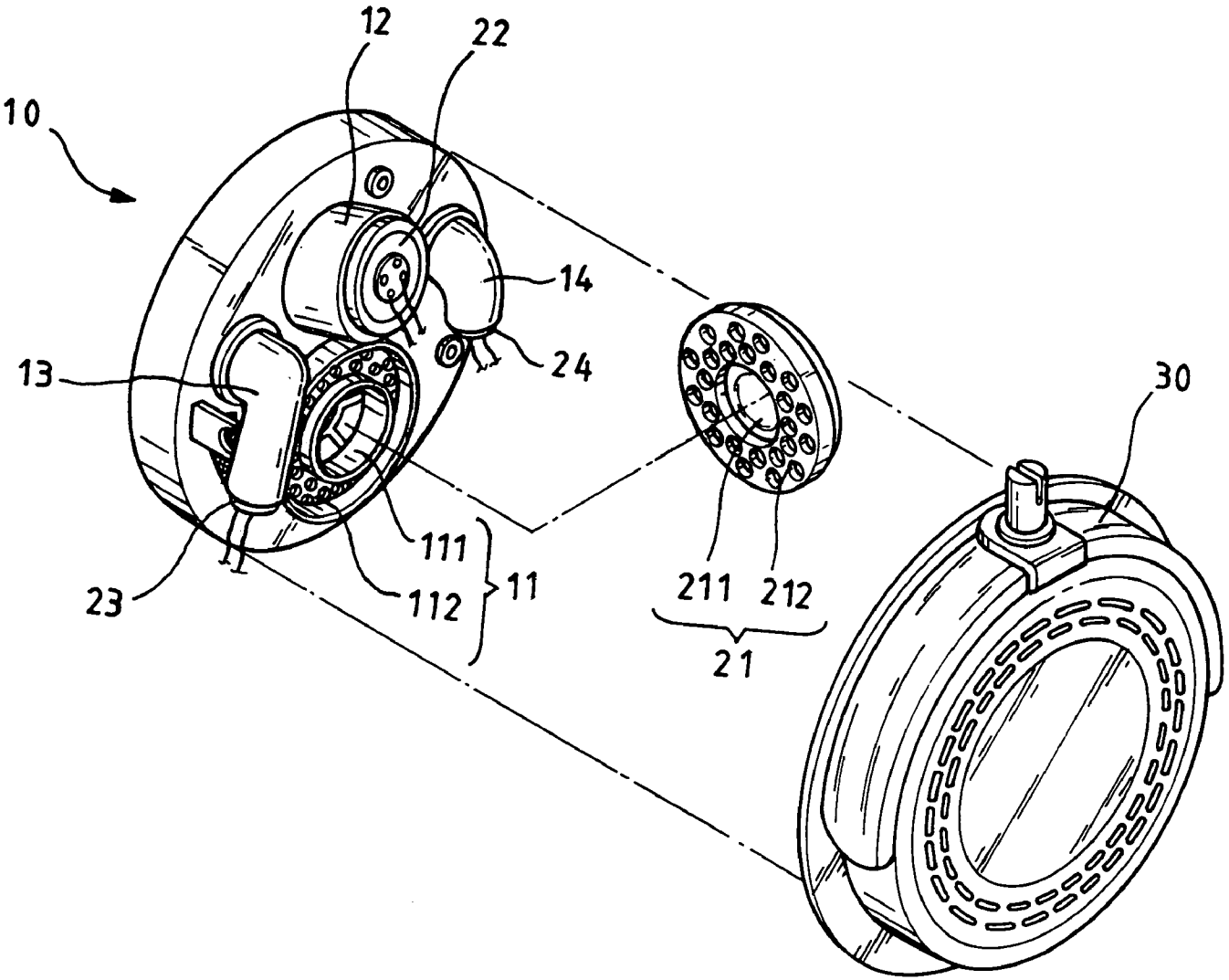
FIG. 3 is an exploded view of the earphone of the invention seen from the other side.

The internal structure of the earphones 1, as shown in FIGS. 2 and 3, includes a main body 10, a cover portion 30 and an ear contact portion 40.

The main body 10 includes a first sound chamber 11 for receiving a front main speaker 21, a second sound chamber 12 for receiving a subwoofer 22, and a third sound chamber 13 for receiving a rear surround speaker 23, thereby forming a headset with a multichannel guiding mechanism. Alternatively, the main body 10 can further include a fourth sound chamber 14 for receiving a middle speaker 24.

The cover portion 30 is attached to an outer side of the main body 10 for covering all of the sound chambers 11, 12, 13, 14 and the speakers 21, 22, 23, 24.

The ear contact portion 40 is attached to an inner side of the main body 10 and provides ears with a greater comfort.

Figure 4:
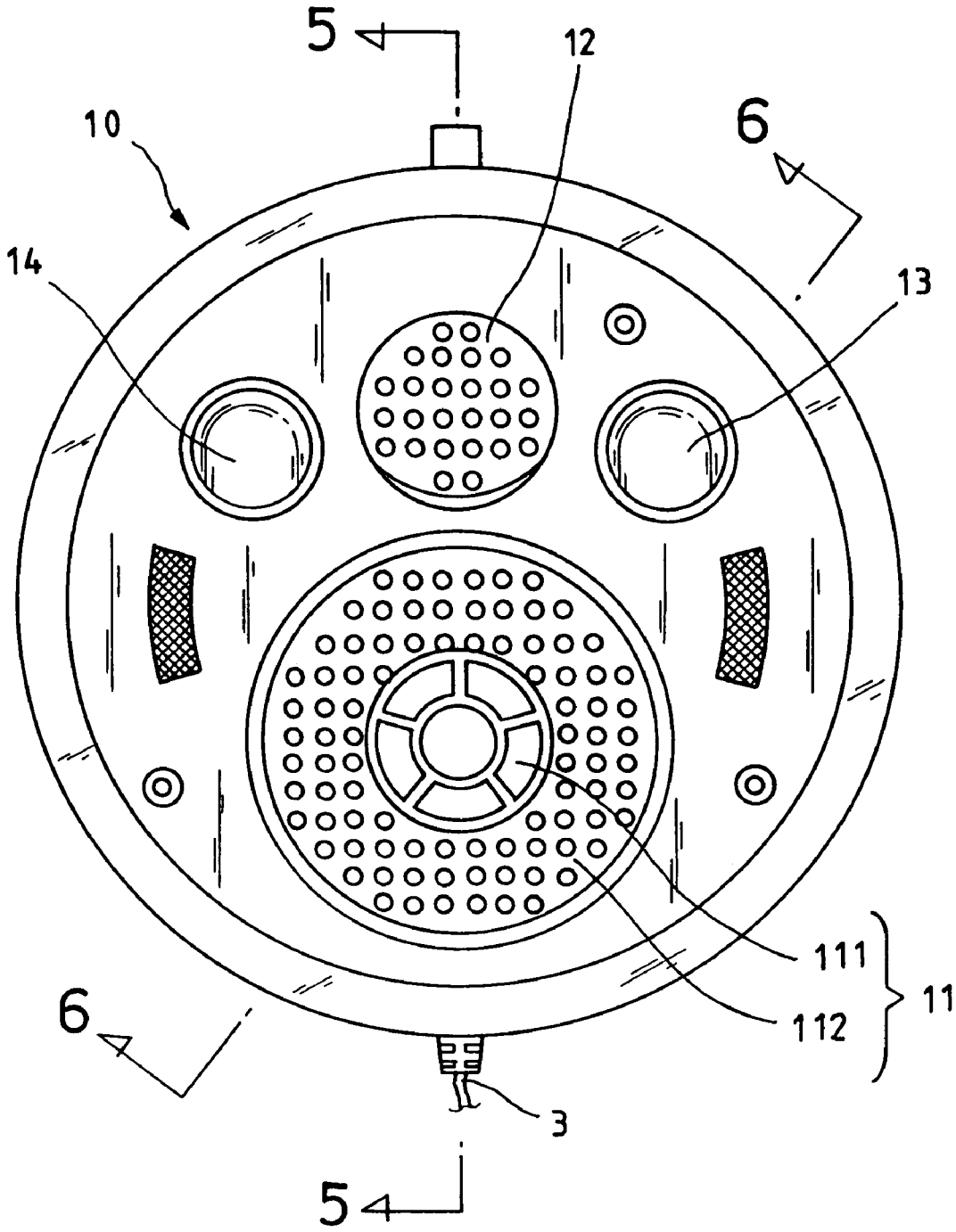
FIG. 4 is a front view of the earphone of the invention.
Figure 5:
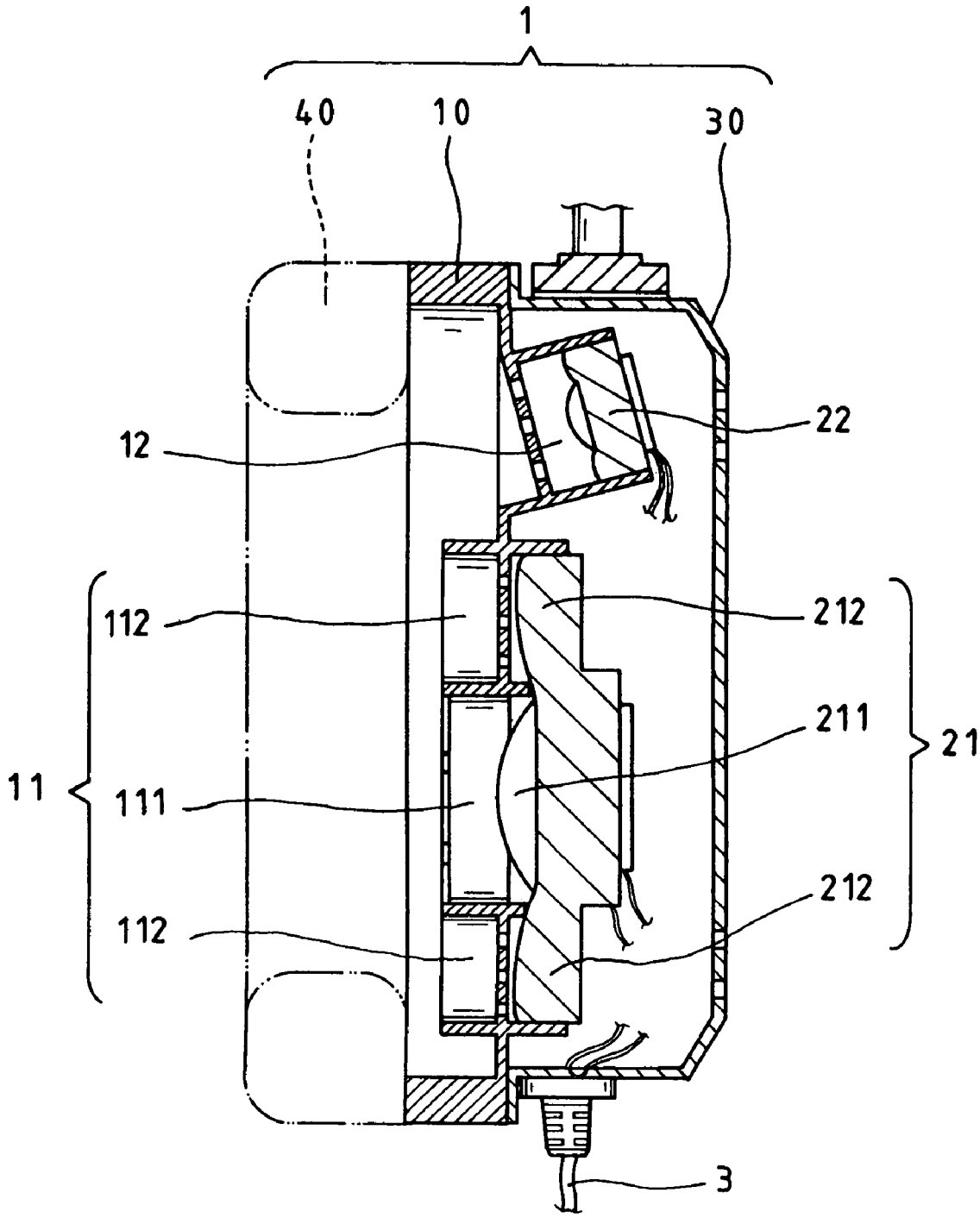
FIG. 5 is a cross-sectional view taken along the line 5-5 of FIG. 4.
Figure 6:
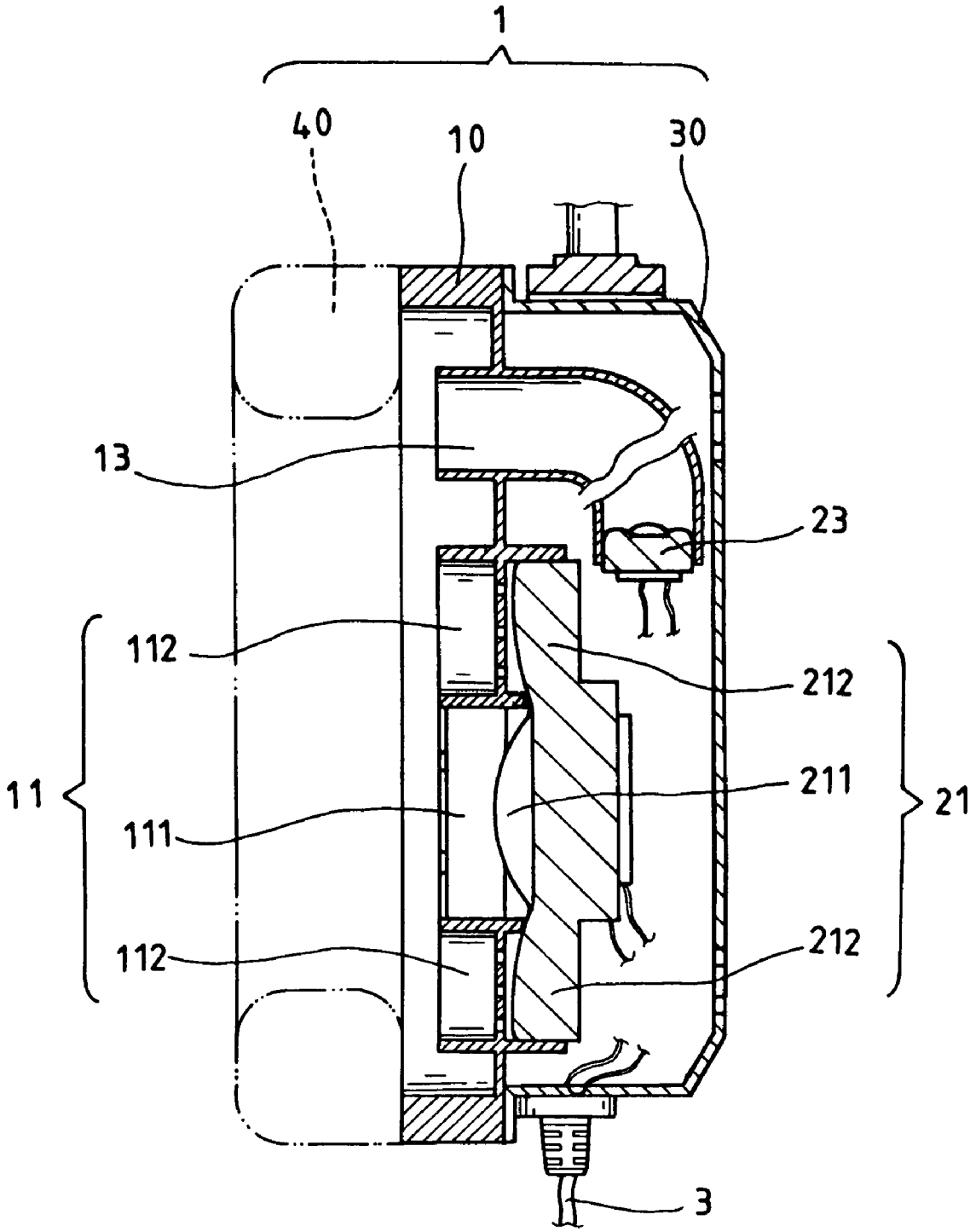
FIG. 6 is a cross-sectional view taken along the line 6-6 of FIG. 4.

As shown in FIGS. 4, 5 and 6, the first sound chamber 11 is larger in size for installing the front main speaker 21. The front main speaker 21 includes a treble area 211 in the middle thereof and a bass area 212 around the treble area 211. In order to reduce the interference of the treble and the bass within the first sound chamber 11, an inner tube 111 for transmitting the treble and an outer tube 112 for transmitting the bass are disposed in the treble area 211 and the bass area 212, respectively. According to actual test results, the tube-in-tube (the inner tube 111 within the outer tube 112) arrangement in the first sound chamber 11 ensures an improvement of the sound quality.

Referring to FIG. 5, the heavy bass speaker 22 is installed above the front main speaker 21. This is an optimal installation position for the subwoofer 22. Moreover, the subwoofer 22 within the second sound chamber 12 is disposed at a certain angle relative to a horizontal plane such that it is downwardly inclined to protect the human ears from direct exposure to the output sound wave and to create a surround spatial acoustic field for the user's ears.

As shown in FIGS. 4 and 6, the rear surround speaker 23 is disposed at an upper, a lower, or a central position behind the front main speaker 21. Moreover, the sound tube for installing the rear surround speaker 23 within the third sound chamber 13 can be extended as far as possible so as to create a sound wave delay effect. Since the sound passes through a long sound tube, more surround acoustic field will be produced and the surround sound quality will be enhanced. In order to make the elongated sound tube much longer, it can be formed in a curved shape. However, its shaped must not be restricted to the curved shape. In fact, the length of the sound tube is the key point of the surround effect. Since the internal room within the earphones 1 is much limited, the curved sound tube is therefore an optimal solution for a better sound effect without increase of the whole dimensions of the earphones 1.

Again, referring to FIGS. 2, 3, and 4, the earphone 1 consisting of the front main speaker 21, the rear surround speaker 23 and the subwoofer 22 can reach multichannel sound effect by a special design of the separate sound chambers. In order to reach the 5.1-channel effect, the middle speaker 24 is disposed at an upper, a lower, or a central position before the front main speaker 21. The fourth sound chamber 14 for receiving the middle speaker 24 can be formed in a curved shape as well; however, the length thereof is much shorter than the third sound chamber 13 for receiving the rear surround speaker 23. The internal structure of the fourth sound chamber 14 corresponds substantially to that of the third sound chamber 13.

Figure 7:
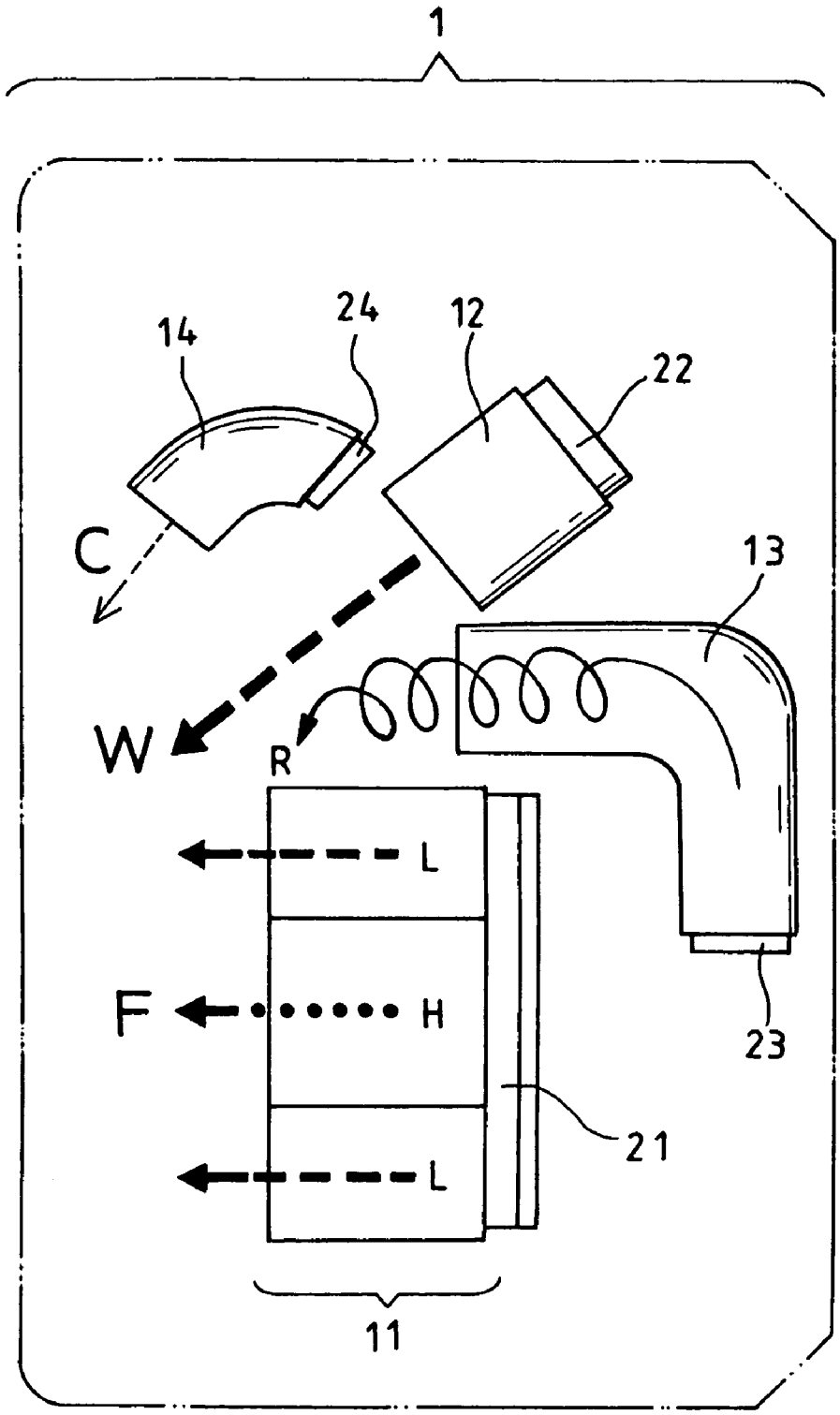
FIG. 7 is a schematic drawing of all channel speakers and their separate sound chambers.

Unlike the conventional headphones in which different channel loudspeakers are separated only by respective sound walls, the headphones of the invention take the sound transmission principles and the acoustic structure into account and feature separate sound chambers for different channel loudspeakers in accordance with their characteristics. Accordingly, all the loudspeakers can produce their unique sound quality and allow a clear positioning of their acoustic fields. As shown in FIG. 7, the sound chambers 11, 12, 13 designed in accordance with the characteristics of the front main speaker 21, the subwoofer 22, and the rear surround speaker 23 are integrated in an earphone 1, thereby allowing the front main channel (F) to have the treble area (H), the bass area (F), the subwoofer (W), and the rear surround channel (R). These are what the conventional headphones don't have. Furthermore, a middle speaker 24 together with its sound chamber 14 is installed within the earphone 1 for creating a central channel, thereby forming a perfect 5.1-channel earphones with all different channel loudspeakers to show their own characteristics and achieving a clear, interference-free, and balanced reproduction of the original sound.

Figure 8:
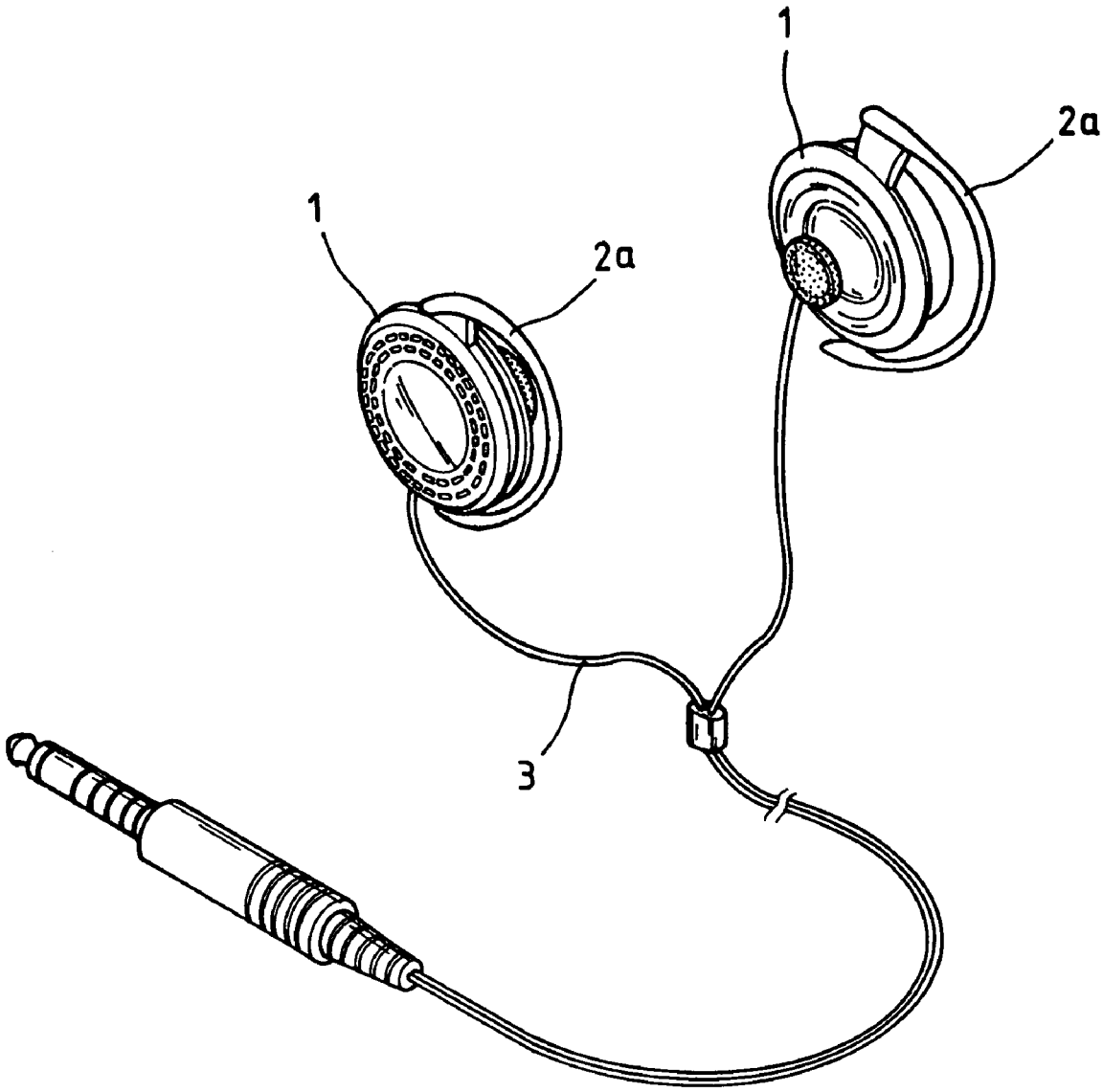
FIG. 8 is a perspective view of the earphones with a hook portion.
Figure 9:
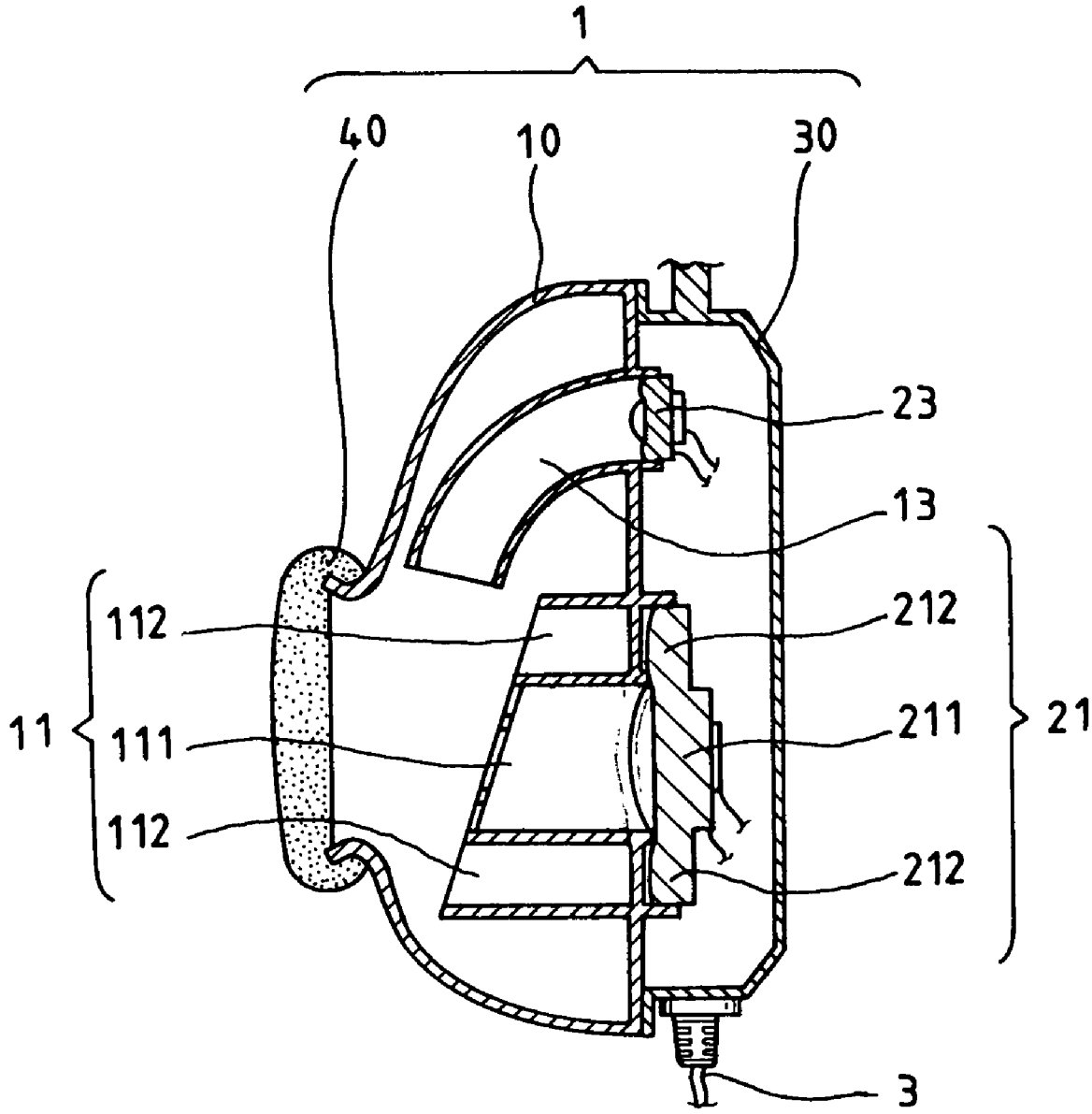
FIG. 9 is a cutaway view of the earphones in accordance with FIG. 8.

As shown in FIG. 8, the dimension of the aforementioned earphones 1 of the invention can be reduced to form another embodiment of the invention. In the embodiment of the invention according to FIG. 8, a hook portion 2*a* for hanging the earphone 1 over the ear is provided for form a set of earphones without a headband 2 and similarly having several separate sound chambers. As shown in FIG. 9, the main body 10 includes a ear contact portion 40 that is tapered at the inner side thereof for adapting itself to the ear's shape. The ear contact portion 40 is so big as an earplug and wearable over the outer ear. In order to save the space, the cover portion 30 is formed in a thinner way. The first sound chamber 11 for receiving the front main speaker 21 is forwardly extended to form a slope. In addition, the third sound chamber 13 for receiving the rear surround speaker 23 is also extended forwardly over a certain length so as to enhance the surround effect. The other speakers as subwoofer, middle speaker and their sound chambers are designed as that of the aforementioned embodiment. Thus, no further descriptions are given hereinafter.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. Headphones with multichannel guiding mechanism having a pair of earphones, each of the earphones comprising:

a) a main body having a first sound chamber for receiving a front main speaker, a second sound chamber for receiving a subwoofer being disposed above the first sound chamber, and a third sound chamber for receiving a rear surround speaker being located at an upper, a central, or a lower position behind the first sound chamber, an inner and an outer tube being installed within the first sound chamber, the inner tube defining a treble area in the middle of the front main speaker, the outer tube defining a bass area around the treble area whereby the first sound chamber has a tube-in-tube configuration;

b) a cover portion attached to an outer side of the main body for covering all of the separate sound chambers and the speakers within the sound chambers; and c) an ear contact portion attached to an inner side of the main body.

2. The headphones as recited in claim 1 further comprising a middle speaker received within a fourth sound chamber, the fourth sound chamber being located at an upper, a lower, or a central position before the first sound chamber.

3. The headphones as recited in claim 1 wherein the second sound chamber receiving the subwoofer is positioned at a certain angle relative to a horizontal plane.

4. The headphones as recited in claim 1 wherein the third sound chamber for receiving the rear surround speaker is constructed as an elongated tube.

5. The headphones as recited in claim 4 wherein the elongated tube is bent at an certain angle.

6. The headphones as recited in claim 1 wherein the earphones are connected by a headband for holding them on the top of the head.

7. The headphones as recited in claim 1 wherein each of the earphones is provided with a hook portion for hanging the earphone over the ear.

* * * * *

UNITED STATES PATENT AND TRADEMARK OFFICE

CERTIFICATE OF CORRECTION

PATENT NO. : 7,340,071 B2
APPLICATION NO. : 10/857872
DATED : March 4, 2008
INVENTOR(S) : Jui-Shu Huang It is certified that error appears in the above-identified patent and that said Letters Patent is hereby corrected as shown below:

On the Title Page:

Add Block (63) as Follows:

-- Related U.S. Application Data

(63) Continuation-In-Part of Application No. 10/000,505

Filed on December 4, 2001, Now Abandoned --

Signed and Sealed this

Second Day of December, 2008

JON W. DUDAS
*Director of the United States Patent and Trademark Office*